United States Patent [19]

Volkert et al.

[11] 4,313,270

[45] Feb. 2, 1982

[54] ITEM WITH PIVOTING POP-UP

[75] Inventors: John K. Volkert, Northfield; Ib Penick, Prospect Heights; Robert B. Volkert, Wilmette, all of Ill.

[73] Assignee: Compak Systems, Inc., Northfield, Ill.

[21] Appl. No.: 153,931

[22] Filed: May 28, 1980

[51] Int. Cl.[3] ..... G09F 19/00

[52] U.S. Cl. ..... 40/124.1; 46/34

[58] Field of Search ..... 40/124.1, 530; 46/34, 46/35, 36, 37; 428/12, 43

[56] References Cited

U.S. PATENT DOCUMENTS

| | | | |
|---|---|---|---|
| 1,182,077 | 5/1916 | Colucci | 46/34 |
| 3,995,388 | 12/1976 | Penick et al. | 428/43 X |
| 4,146,983 | 4/1979 | Penick et al. | 40/124.1 |

*Primary Examiner*—Henry F. Epstein

*Attorney, Agent, or Firm*—Fitch, Even, Tabin, Fllanery & Welsh

[57] ABSTRACT

An illustrative or promotional item having front and rear relatively pivotable covers joined together along a vertical line and a die-cut panel which includes a plurality of subpanels having upper and lower extensions. The lateral edge of each extension nearest the vertical line carries a hinged tab, and the opposite lateral edge of each extension is connected to the remainder of the die-cut panel along vertical hinge line segments. A section of the remainder of the die-cut panel is adhesively attached to the interior surface of the front cover adjacent the vertical line, and an opening is preferably provided in the front cover through which the subpanels can be seen. When the item is opened by swinging the front and rear covers relative to each other, the subpanels pivot to become oriented edgewise to the rear cover. Preferably, the proportions are such that, upon opening completely, the front and rear covers lie in the same plane and the subpanels have rotated 180° so that the rear surfaces of the panels are now visible and the front surfaces lie obscured adjacent the interior surface of the rear cover.

14 Claims, 11 Drawing Figures

ANNOUNCING
LPOE
CUET
A
B
C
D 11b
13b
33
25
15b
61
63
45
65
67
15c
35
19c
13c
37
A
13c
19c
69
B
71
13c
19c
73
C
19c
11c
61c
D 77
37
75
35
21
19d
15d
A
77
13d
33
19d
45
15d
B
37
13d
25
79
19d
15d
C
81
D 35
21
81
19e
77
15e
37
13e
A
83
19e
45
15e
37
85
B
35
19e
15e
13e
85
C
87
13e
D
89

ITEM WITH PIVOTING POP-UP

BACKGROUND OF THE INVENTION

This invention relates to printed paper novelty items of various types and more particularly to dimensional and specialty paper products of this general character wherein a "pop-up" is provided that, upon opening of the item, moves upward and out of the plane of either of the cover panels.

Advertising hand-outs, inserts, mailers and the like are being used with greater and greater frequency to promote a particular product or service. Moreover, items of this general character are often used together with accompanying text in order to illustrate a particular theme or perhaps an incident in a story. Although the value of such an item as an illustration in a book or the like is obvious, its value in an advertising or promotional item lies in the attention of the recipient which it hopes to gain. Accordingly, commercially practical items of this general type which incorporate attention-getting features remain in demand, along with ways for mass-producing such items so as to make distribution economically feasible.

BRIEF SUMMARY OF THE INVENTION

The invention provides an item of this character wherein a die-cut sheet is sandwiched between front and back covers or basepieces. A printed subpanel in the sheet, which can preferably be viewed through an aperture in the front cover, upon opening of the item pivots from a position parallel to the surface of the rear cover to a position oriented edgewise thereto where its front surface is no longer visible. Continued opening movement, until the cover panels are spread flat, preferably causes the subpanel to rotate a total of 180° so that its rear surface is now visible and its front surface lies adjacent the front surface of the rear cover.

DETAILED DESCRIPTION OF THE PREFERRED EMBODIMENTS

Figures 1, 2, 3, 4, 5, 6, 7:
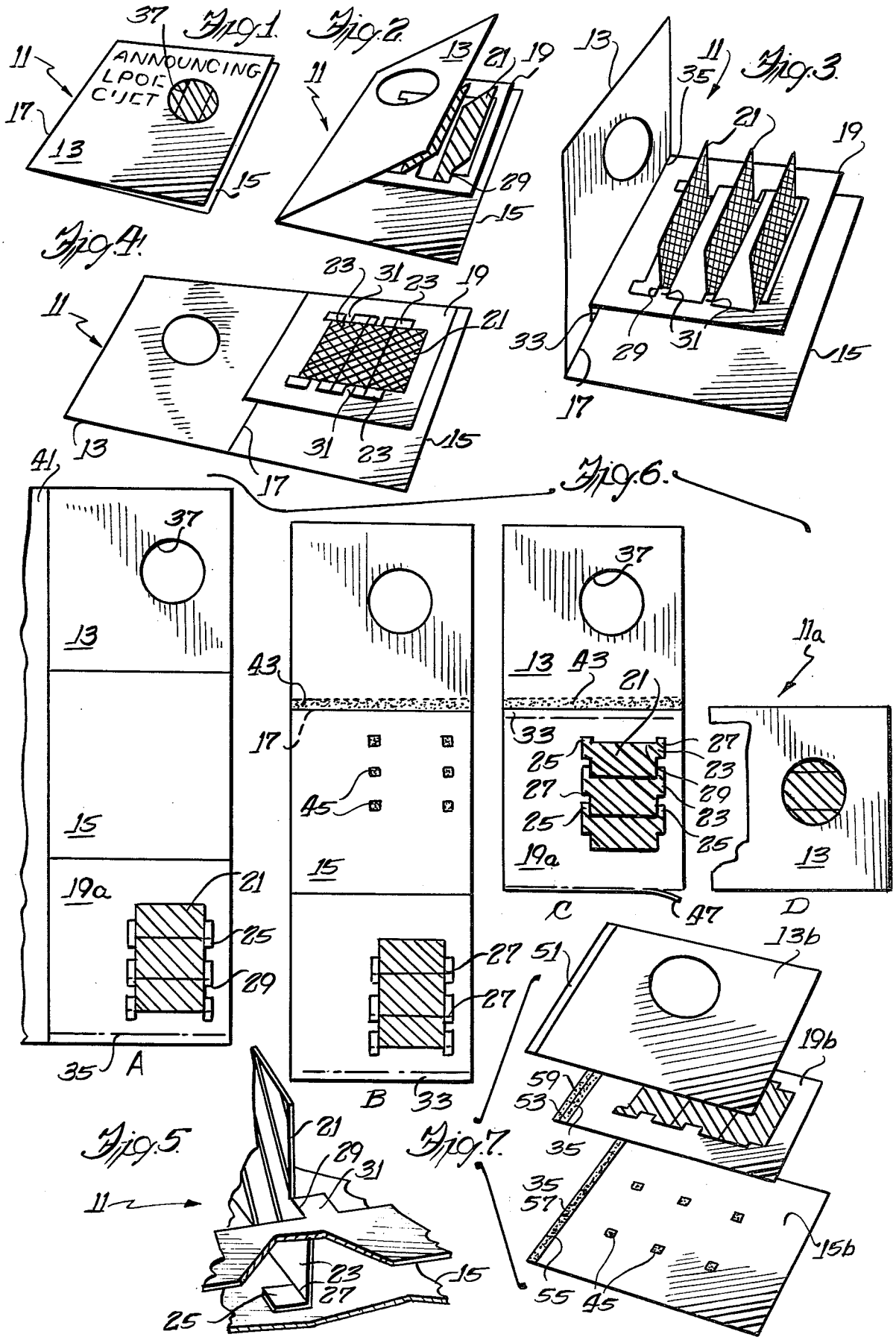
FIG. 1 is a perspective view of an item embodying various features of the invention shown in the closed condition in which it would normally be distributed.
FIG. 2 is a perspective view of the item of FIG. 1 shown in a partially open position.
FIGS. 3 and 4 are perspective views of the item of FIG. 1 shown respectively in the half-open and completely open positions.
FIG. 5 is a fragmentary perspective view, enlarged in size, showing the item of FIG. 3 partially broken away so as to illustrate a hinge portion thereof.
FIG. 6 is a schematic view of a production-line fabrication method illustrating one manner in which items similar to those of FIG. 1 may be made as a part of a web-press operation.
FIG. 7 is an exploded perspective view illustrating an alternative embodiment of an item similar to that shown in FIG. 1.

Illustrated in FIGS. 1 through 5 is an item 11 of the type designed to promote a particular product or service having a front cover or basepiece 13 and a rear cover or basepiece 15 which are hinged together along a vertical fold line 17. Sandwiched between the front and rear covers is a panel 19 which is die-cut and preferably scored to provide three subpanels 21 of precisely the same shape and dimension but which could have different shapes and/or dimensions. Although three subpanels are preferred, one, two or more than three subpanels could be employed depending upon the size of the item and the overall effect which it is desired to create. The panel 19, at least in the region from which the subpanels are die-cut, is preferably printed on both its front and rear surfaces as indicated in the illustrated views by a diagonal line pattern on the front surface and a crisscross line pattern on the rear surface.

Each of the subpanels 21 is formed with upper and lower extensions 23 which extend from about the left one-half of the subpanel, as best seen perhaps in FIG. 5 and in FIG. 6 which is a schematic view of a production-line method for fabricating items very similar to the items 11. Each of the extensions 23 carries a tab 25 which is connected along the left-hand lateral edge thereof by a hinge line 27, which is preferably a score line. The right-hand or opposite lateral edge of each of the extensions 23 is connected to the remainder of the panel 19 by hinge line segments 29 which are preferably co-linear. In the preferred embodiment, as best seen in FIG. 5, the interconnection between the subpanels and the remainder of the die-cut panel 19 at the hinge line 29 is by two generally square projections 31 that extend from the border region into the central region of the panel otherwise occupied by the subpanels.

In fabricating the items 11, the rear surfaces of the tabs 25 are joined to the inward facing surface of the rear cover 15, using any suitable adhesive or other method of joining. A section of the die-cut panel 19 adjacent its left-hand edge is employed as a major hinge element 33 and is preferably defined by a hinge score line 35. The major hinge element 33 is attached, preferably by adhesive or some suitable bonding agent, to the interior surface of the front cover 13 in the region adjacent the hinge line 17.

The length or height of the panel 19 and the hinge element 33, in the illustrated embodiment, is equal to about two-thirds of the length or height of the basepieces 13,15, which are preferably rectangular in shape but which could be of different shapes, if desired. If desired, the height of the die-cut panel 19 may be the same as the height of the covers as is the case in the embodiment shown in FIG. 6. Likewise, although the subpanels 21 are preferably also rectangular in shape, they could be die-cut with different shapes to provide a particular desired effect. The width of the major hinge element 33 is preferably equal to the width of the extensions for a purpose described hereinafter.

The recipient of item 11 will generally initially view it in the form depicted in FIG. 1 although the item could be fabricated so that the printing is oriented 90° to that illustrated, as mentioned hereinafter. The front cover 13 would normally contain a printed message which might include art work and contains an aperture 37 through which the central portion of the die-cut subpanels 21 can be seen. As the recipient begins to open the item 11, as depicted in FIG. 2, by pivoting the front cover 13 relative to the rear cover 15, the adhesive connection between the major hinge element 33 and the interior surface of the front cover pulls the die-cut panel 19 away from the plane of the rear cover 15. Because of the adhesive connections between the tabs 25 and the interior surface of the rear cover 15, the subpanels 21 rotate relative to the plane of the die-cut panel 19 about axes defined by the hinge lines 29.

When the item is half-way open, as depicted in FIG. 3, the subpanels 21 are disposed edgewise and substantially perpendicular to the rear cover 15. In this position, the indicia printed on the front surfaces of the subpanels is no longer readily visible, and if indicia is printed on the rear cover 15 in the region behind the subpanels 21, such printed indicia or message would be fully visible to a recipient with the item in the half-way open position. One can recognize this as being likened to looking through a venetian window blind in the open position.

In the illustrated embodiment, when the item 11 has been fully opened so that the front cover and rear cover are disposed at 180° to each other in essentially the same plane, as illustrated in FIG. 4, the subpanels 21 have rotated substantially 180°, and the rear surfaces of the subpanels are now fully visible to the recipient, as indicated by the crisscross line pattern. The division of the central region in the die-cut sheet 19 into a plurality of rectangles is advantageous in that, following the 180° rotation of each of the subpanels, the central region remains totally filled by the subpanels, and thus a complete and contiguous message or picture can be displayed on both surfaces, which will of course change to give the desired and striking effect. Of course, as earlier indicated, different subpanel shapes than rectangular can be employed to achieve different effects.

As earlier indicated, the dimensioning of the major hinge element 33 and the extensions 23 is such that the widths are substantially equal. These widths control the amount of pivoting of the subpanels which occurs as the front cover 13 is pivoted relative to the rear cover 15. When the widths are equal, the subpanels 21 are substantially perpendicular when the cover 13 is in the half-open position as depicted in FIG. 3 and have rotated 180° when the front cover is in the fully opened position. If, for example, the width of the major hinge element 33 was only one-half of the width of the extensions 23 (which constitute the length of the arms about which rotation is occurring) and the left hand edge of the panel 19 was located adjacent the hinge line 17, when the cover 13 is in the fully open position (as depicted in FIG. 4), the subpanels 21 would be edgewise or perpendicular to the rear panel 15. If, on the other hand, the width of the major hinge element 33 was twice the width of the extensions 23, by the time the item is opened to the position of the covers in FIG. 3, the subpanels 21 will have fully rotated substantially 180°.

Although the item has been described in its preferred embodiment wherein the hinge line 17 is located at the left hand edge, it could also be fabricated so that it was at the top or bottom edge. In such a case, all of the hinged connections would be oriented horizontally. Accordingly, it should be understood that the term "vertical" is used in the specification and claims as a convenient term of reference and does not constitute any specific directional limitation.

Depicted in FIG. 6 is a method for the fabrication of an item 11*a* which is essentially the same as the item 11 except that the die-cut panel 19*a* is of full height whereas the panel 19 was of only partial height. Accordingly, the elements in FIG. 6 which are the same as the elements in FIGS. 1 through 5 are referred to by the same reference numbers.

FIG. 6 illustrates a diagrammatic view of the production of the item 11*a* as a part of an in-line web printing press arrangement which is capable of high-speed mass production operation. A printed web 41 is delivered first to a die-cutting station A where die-cutting and press scoring is carried out. Although lines of demarcation are shown in the web 41 between the region which constitutes the front cover panel and the region which constitutes the rear cover panel 15, and likewise between it and the region which constitutes the panel 19*a*, it should be understood that these are for purposes of aiding in the explanation and that these lines of demarcation are normally formed as a part of the folding operations which subsequently occur during the continuous movement of the web from left to right in FIG. 6. At Station A, the aperture 37 is die-cut in the region of the panel 13, and the subpanels 21, the extensions 23 and the tabs 25 are die-cut from the region that constitutes the panel 19*a*. At the same time, the web is preferably press-scored to impress the score line 35 which defines the major hinge element 33 and the hinge lines 27 and 29 at the lateral side edges of the extensions 23.

At Station B, an adhesive pattern 43 is applied to the web in the region of the front cover 13 adjacent what will become the hinge line 17. Another adhesive pattern 45 is applied to six locations in the region of the rear cover panel 15 which will be aligned with the tabs 25. If desired, these adhesive patterns could be applied directly to the tabs and to the major hinge element 33. As the web moves from Station B to Station C, the region constituting the die-cut panel 19*a* is folded over onto the rear cover panel 15, and the tabs 25 are bonded thereto by means of the adhesive pattern 45. At Station C, the lower edge 47 is trimmed from the two folded panels so as to separate the panel 19*a* from the rear cover except for the attachment in the region of the six tabs 25. Trimming may be deferred until the web leaves Station D.

As the web moves from Station C to Station D, the front cover 13 is folded onto the other two panels to bring it into superimposition thereupon. This creates the attachment between the interior surface of the front cover 13 and the major hinge element 33 by means of the adhesive pattern 43 and completes the fabrication of the item. As the web leaves Station D, it is served transversely to separate it into individual units. The completed item 11*a* appears the same as that depicted in FIGS. 2 through 4 with the exception that the die-cut panel 19*a* extends all the way to the bottom edge of the item.

Figures 8, 9, 10, 11:
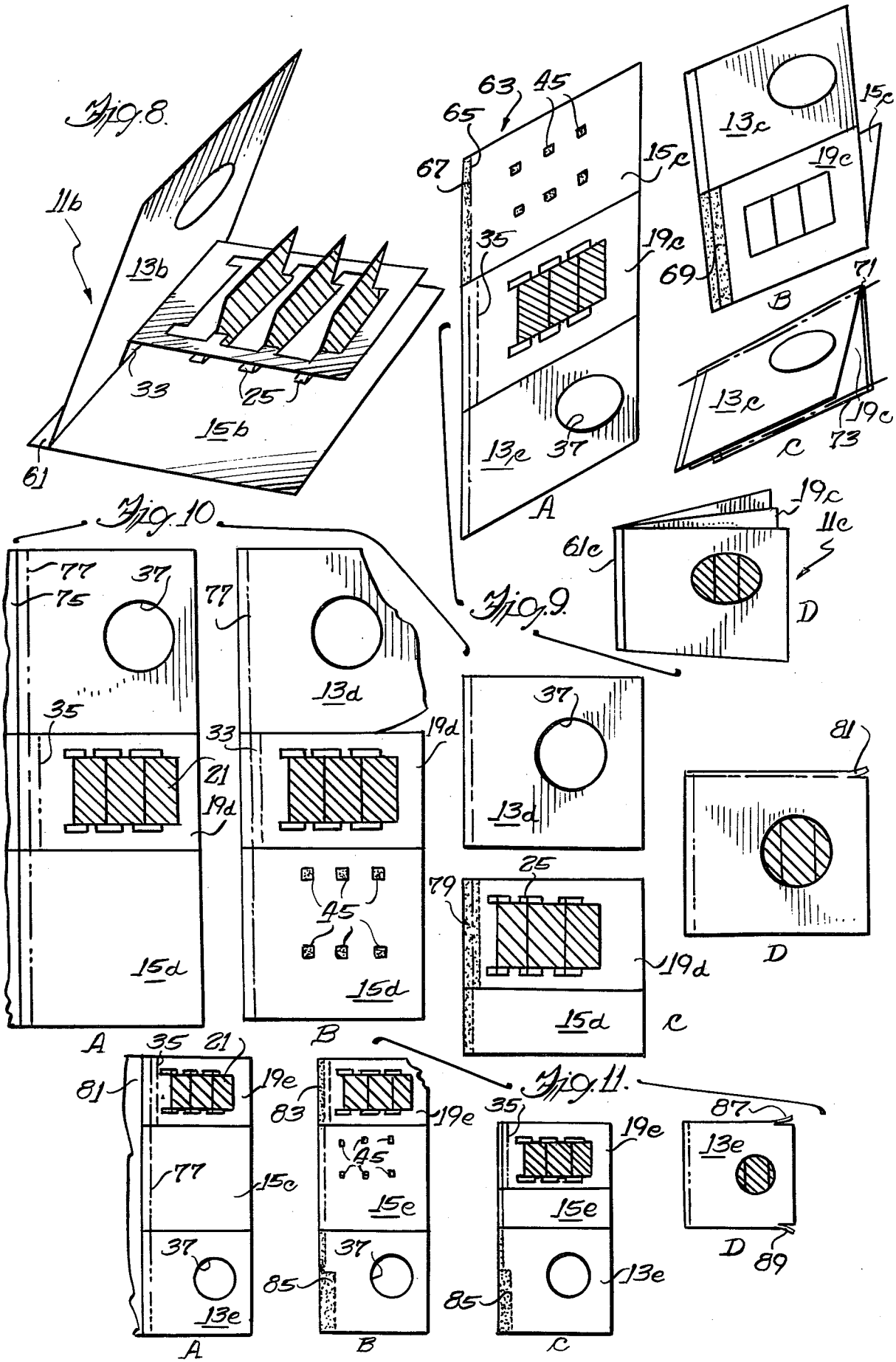
FIG. 8 is a perspective view of the item depicted in FIG. 7.
FIG. 9 is a schematic view illustrating a production-line fabrication method by which an item generally similar to that depicted in FIG. 8 may be made as part of a web-press operation.
FIGS. 10 and 11 are schematic views of alternative production-line fabrication methods wherein items of the type depicted in FIG. 8 may be made as part of a web-press operation.

Depicted in FIGS. 7 and 8 is an alternative embodiment of an item wherein, instead of utilizing a natural hinge line between the front and rear cover, the sheet material is cut into separate sheets (or, if desired, different paper stock can be employed), and the left-hand region of each of the sheets is adhesively attached to the adjacent sheet to make what is referred to as a false backbone. In FIG. 7, the cover 13*b* may be provided with a score line 51 which defines the edge region, or the score line may be optionally omitted. The die-cut panel 19*b* is formed with a pair of score lines 53 and 35 which respectively define the edge backbone region and the main hinge element; however, again either of these can be omitted. Likewise, the rear cover panel 15*b* may also be provided with a score line 55 which defines the edge region, but the line 55 is often omitted.

A glue pattern 57 is applied to the edge region of the bottom panel, and a glue pattern 45 is applied to the central region of the bottom panel for the purpose previously indicated. A glue pattern 59 is applied along the left-hand edge of the die-cut panel 19*b* covering both the backbone edge portion and the main hinge element.

When the three panels are superimposed with the die-cut panel 19*b* sandwiched between the cover panels, the adhesive patterns 57 and 59 create the three-layer thick false backbone 61 shown in FIG. 8 and secure the major hinge element 33 to the interior surface of the cover 13*b*. Likewise, the adhesive pattern 45 attaches the tabs 25 to the interior surface of the rear cover 15*b*, completing the fabrication of the item 11*b* shown in FIG. 8. When the item is opened by pivoting the covers relative to each other, the appearance, as seen in FIG. 8, is substantially the same as that of the item 11 depicted in FIGS. 1 through 5.

FIG. 9 shows an alternative embodiment of a fabrication method designed for producing an item similar to the item 11*a* depicted in FIG. 6 wherein all three of the panels are of the same height. The fabrication method depicted in FIG. 9 is also suitable for fabrication at the end of a web-press operation. The web can be thought of as comprising an endless series of sheets 63 each of which will be fabricated into a promotional item 11*c*.

As exemplified in view 9A, the sheet 63 is initially die-cut in its central region 19*c* and to remove the aperture 37 from the region 13*c* at the bottom. Score lines are also preferably impressed in the die-cut region as indicated hereinbefore, and a score line 65, which extends all the way across the web along what may be visualized as the trailing edge of the yet uncut sheet 63, is also preferably impressed to create the backbone edge region. The parallel score line 35 is preferably also impressed in the center region 19*c*. The adhesive pattern 45 is applied to what will become the interior surface of the rear cover panel 15*c*, and an adhesive pattern 67 is also applied along the edge region of the same panel.

The panels 19*c* and 13*c* are then folded over onto the panel 15*c* as depicted in view 9B, effecting adhesive attachment between the rear cover panel and the die-cut panel 19*c* in the region of the tabs and the left-hand or trailing edge. An adhesive pattern 69 is then applied to the trailing edge of the central panel 19*c* from the score line 35 back to the edge. Next, the cover panel 13*c* is folded into superimposed position atop the panel 19*c* as depicted in FIG. 9C, completing the formation of the false backbone and adhesively attaching the major hinge element 33 to the interior surface of the cover panel 13*c*. Following this folding step, the upper edge 71 and the lower edge 73 are trimmed from the three-layer thick longitudinally moving web, completing the fabrication, and the web is then severed transversely to create the individual units 11*c*. As depicted in FIG. 9D, the unit 11*c* has a false backbone 61*c* and is generally similar to the item 11*b* depicted in FIG. 8 with the exception that the die-cut panel 19*c* extends for the full height of the item.

Illustrated in FIG. 10 is another alternative embodiment of a web-press production method for making an item substantially the same as the item 11 depicted in FIGS. 1 through 5. A web 75 at Station A is die-cut to remove the aperture 37 and to die-cut and score the subpanels 21 in the central region which constitutes the panel 19*d*. The score line 35 which defines the major hinge element 33 and a score line 77, which extends completely across the web along the trailing edge to define the false backbone region, are preferably impressed.

At Station B, the adhesive pattern 45 is applied to the region of the web which constitutes the rear panel 15*d*. As the web leaves the station B, the front cover panel 13*d* is cut from the remainder of the web. Between Stations B and C, the center panel 19*d* is folded atop the rear cover panel 15*d*, and the adhesive attachment of the tabs 25 is effected. At the Station C, an adhesive 79 is applied along the trailing edge region of the rear and center panels and in the region of the major hinge element 33.

As the web moves between Stations C and D, the strip of the web constituting the cover panels 13*d* is superimposed with the remainder of the web and brought into surface contact therewith. Adhesive joinder is effected by means of the adhesive pattern 79, and the upper edge 81 is then trimmed from the three-layer web, completing the fabrication method. The web is then cut transversely to create the individual units which are substantially the same as the unit 11*b* depicted in FIG. 8.

Illustrated in FIG. 11 is still another embodiment for creating an item generally similar to that depicted in FIG. 8. A web 81 is die-cut and press scored in essentially the same manner as the web 75 in FIG. 10, except that the die-cut panel 19*e* appears at the upper edge of the web, the rear cover panel 15*e* in the center and the front cover panel 13*e* at the lower edge. At Station B, an adhesive pattern 83 is applied to the die-cut panel 19*e* in the backbone edge region, and an adhesive pattern 85 is applied to the front cover panel 13*e* along the edge region and also in the region which will register with the major hinge element 33. The adhesive pattern 45 is also applied to what will be the interior surface of the rear cover panel 15*e*.

As the web moves from Station B to Station C, the upper panel 19*e* is folded onto the rear panel 15*e* effecting adhesive attachment in the backbone edge region and at the six tabs 25. As the web moves from Station C to Station D, the front cover panel 13*e* is folded up onto the central portion of the web to superimpose it atop the other two layers, effecting adhesive attachment at the backbone edge region and in the region of the major hinge element 33. At the Station D, a thin strip 87 is trimmed from the top of the web, and a similar strip 89 is trimmed from the lower edge of the web. This completes the fabrication method, and the web is cut transversely to produce the individual units which, when opened by a recipient, will have the same appearance as that depicted in FIG. 8.

Although the invention has been described with regard to certain preferred embodiments, it should be understood that changes and modifications as would be obvious to one having the ordinary skill in the art may be made without departing from the scope of the invention which is set forth in the appended claims. For example, although fabrication has been illustrated with respect to web press operation where the folding is effected about lines that are longitudinal to the direction of web travel, folding can also be carried out about lines transverse to the direction of travel by laying out the items in multiple groups and in an orientation at 90° to that illustrated in FIG. 11. The web is the sheeted by cutting it transversely, and the sheets are then folded twice by suitable apparatus, which may operate similar to a blade or knife-folder or to a buckle-plate folder, before being trimmed and cut into individual units in a conventional manner. Likewise a stack of individual sheets can be similarly fabricated.

Moreover, should it be desired to obscure the hinges from the view of the recipient, a frame can be provided in the form of a fourth panel that is disposed between the die-cut panel and the basepiece which forms the front cover. In such an instance, the adhesive connection is made indirectly by joining the rear surface of the fourth panel to the remainder of the die-cut panel and attaching its front surface to the rear surface of the front cover. As for specific examples of fabricating such a piece, the fourth "frame" panel could be located at the top of the web 41 in FIG. 6 or at the bottom of the web 81 in FIG. 11, and in either instance the original connection between it and the basepiece 13 would be removed as a part of the final trimming operation.

Particular features of the invention are emphasized in the claims which follow.

What is claimed is:

1. An item of the character described comprising a first basepiece, a second basepiece joined to said first basepiece so as to pivot relative to each other along a vertical line, a die-cut panel having a front surface and a rear surface disposed between said first and second basepieces, said panel having formed therein at least one subpanel, said subpanel having upper and lower extensions each of which has a pair of substantially parallel lateral edges and said subpanel being connected to the remainder of said die-cut panel only by vertical hinge lines formed respectively along one said lateral edge of each of said extensions, hinged tabs carried by said other lateral edge of each of said extensions, means attaching each of said tabs to said first basepiece, and means interconnecting said remainder of said die-cut panel and said second basepiece so that opening of said item by pivoting one of said basepieces about said vertical line relative to the other causes said subpanel to simultaneously pivot about said vertical hinged connections at each said one lateral edge relative to the plane of the remainder of said die-cut panel and become oriented edgewise thereto.

2. An item in accordance with claim 1 wherein said second basepiece contains aperture means through which said front surface of said subpanel is visible prior to opening said item.

3. An item in accordance with claim 1 wherein a plurality of subpanels are formed in said die-cut panel, each having extensions and hinged tabs and wherein said remainder of said die-cut panel includes a border that generally surrounds said subpanels.

4. An item in accordance with claim 3 wherein the rear surfaces of said tabs are adhesively connected to said first basepiece.

5. An item in accordance with claim 4 wherein the front surface of a section of said remainder of said panel is adhesively attached to said second basepiece to form said interconnecting means.

6. An item in accordance with claim 5 wherein the location of said section upon said second basepiece is such that, upon 180° of relative pivotal movement of such basepieces, said subpanels also pivot substantially 180° to obscure said front surfaces of said subpanels which were originally visible and to expose said rear surfaces of said subpanels.

7. An item in accordance with claim 6 wherein the width of said section is substantially equal to the width of said extensions.

8. A method of making an illustrative or promotional item, which method comprises die-cutting a first panel of printed sheet material in a region where printing appears to form at least one subpanel which remains hinged along line segments to the remainder of said panel and which includes a pair of hinged tabs at spaced locations from said hinge line segments, applying adhesive to said sheet material and folding said sheet material about a first line to bring a rear surface of said first panel into surface contact with a second panel of said sheet material and to adhesively attach said rear surface of said hinged tabs to said second panel, superimposing a third panel of said sheet material with said first and second panels and adhesively interconnecting the front surface of a portion of said remainder of said first panel and the facing surface of said third panel, and cutting said folded sheet material panels generally along said first line to sever said die-cut first panel from said second panel whereby an item is produced wherein the front surface of said subpanel is initially visible as one opens said unit by moving said second and third panels relative to each other and wherein continued movement causes said die-cut subpanel to pivot about said hinged connections and become oriented edgewise to said second panel.

9. A method in accordance with claim 8 wherein said second and third panels have a common edge and are folded about said common edge to effect said superimposing.

10. A method in accordance with claim 9 wherein said common edge is parallel to said first line and said superimposed assembly is cut generally along said common edge to sever said second and third panels from each other.

11. A method in accordance with claim 8 wherein second and third panels are adhesively attached to each other along an edge that is generally perpendicular to first line.

12. A method in accordance with claim 8 wherein said third panel and said first panel have a common edge and are folded about said common edge to effect said superimposing.

13. A method in accordance with claim 12 wherein said common edge is parallel to said first line and said superimposed assembly is cut generally along said common edge to sever said second and third panels from each other.

14. An item of the character described comprising a first basepiece, a second basepiece joined to said first basepiece so as to pivot relative to each other along a vertical line, a die-cut panel having a front surface and a rear surface disposed between said first and second basepieces, said panel having formed therein a plurality of generally rectangular subpanels and a surrounding border, said subpanels each having upper and lower extensions, each of which extensions has a pair of substantially parallel lateral edges, and said subpanels being connected to the border portion of the remainder of said die-cut panel only by vertical hinge lines formed respectively along one said lateral edge of each of said extensions, hinged tabs carried by said other lateral edge of each of said extensions, means attaching each of said tabs to said first basepiece, and means interconnecting said remainder of said die-cut panel and said second basepiece so that opening of said item by pivoting one of said basepieces about said vertical line relative to the other causes said subpanels to simultaneously pivot about said vertical hinge lines at said one lateral edge of each extension relative to the plane of the remainder of said die-cut panel from an orientation where said front surface of said subpanels is first visible to an orientation where only said rear surface is visible.

* * * * *